US005148586A

United States Patent [19]

Coons, III

[11] Patent Number: 5,148,586

[45] Date of Patent: Sep. 22, 1992

[54] CRIMPED CONTINUOUS FILAMENT YARN WITH COLOR-POINT HEATHER APPEARANCE

[75] Inventor: Andrew M. Coons, III, Anderson, S.C.

[73] Assignee: BASF Corporation, Parsippany, N.J.

[21] Appl. No.: 650,743

[22] Filed: Feb. 5, 1991

[51] Int. Cl.[5] ..... D02G 1/18

[52] U.S. Cl. ..... 28/271; 28/273; 28/219

[58] Field of Search ..... 28/271, 273, 274, 258, 28/219; 57/333, 350

[56] References Cited

U.S. PATENT DOCUMENTS

| | | | |
|---|---|---|---|
| Re. 31,376 | 9/1983 | Sheehan et al. | 57/208 |
| Re. 31,808 | 1/1985 | London, Jr. et al. | 57/6 |
| 2,852,906 | 9/1958 | Breen | 57/34 |
| 3,115,691 | 12/1963 | Bunting, Jr. et al. . | |
| 3,727,275 | 4/1973 | Ohayon | 28/273 X |
| 3,748,648 | 7/1973 | Pugh | 340/172.5 |
| 3,828,404 | 8/1974 | Peckinpaugh et al. | 28/1.4 |
| 4,011,640 | 3/1977 | Keith | 28/274 |
| 4,059,873 | 11/1977 | Nelson | 28/271 |
| 4,069,565 | 1/1978 | Negishi et al. | 28/274 |
| 4,184,316 | 1/1980 | Griset, Jr. | 57/295 |
| 4,343,146 | 8/1982 | Nelson | 57/208 |
| 4,453,297 | 6/1984 | London, Jr. et al. | 28/163 |
| 4,570,312 | 2/1986 | Whitener, Jr. | 28/271 |
| 4,610,131 | 9/1986 | Eschebach et al. | 57/350 X |
| 4,675,142 | 6/1987 | D'Andolfo et al. | 264/103 |
| 4,736,578 | 4/1988 | Shaffer | 28/271 X |
| 4,809,412 | 3/1989 | Nelson | 28/271 |
| 4,841,606 | 6/1989 | Coons, III | 28/274 |
| 4,894,894 | 1/1990 | Coons, III et al. | 28/271 |
| 4,993,130 | 2/1991 | Coons, III et al. | 28/271 |
| 5,027,486 | 7/1991 | Niederer | 28/271 X |
| 5,040,276 | 8/1991 | Coons, III et al. | 28/271 X |

*Primary Examiner*—Werner H. Schroeder
*Assistant Examiner*—Bibhu Mohanty

[57] ABSTRACT

A process for making a heather-dyeable or precolored heather yarn product comprises supplying a first crimped continuous filament yarn in the form of a loose matrix substantially free of filament entanglement and a second crimped continuous filament yarn which is differentially dyeable or precolored with respect to the first yarn. The second yarn is fed through a first entangling or interlacing zone and exposure of the second yarn to a fluid jet in the first entangling zone is randomly controlled to produce a color-point yarn product as the second yarn exits the first entangling zone, in which the color-point yarn product has relatively compact nodal regions of high entanglement of the filaments of the second yarn separated by bulkier regions of the same filaments relatively free of entanglement. The first yarn and the color-point yarn product are then fed through a second entangling zone which randomly entangles filaments of the yarns from yarn to yarn and in which yarn-to-yarn filament commingling is substantially prevented within the nodal regions of the color-point yarn. An apparatus for performing the process includes a randomly controllable fluid valve supplying fluid to the fluid jet in one embodiment, and a randomly controllable yarn guide to move the yarn into and out of the fluid jet in another embodiment.

12 Claims, 2 Drawing Sheets

CRIMPED CONTINUOUS FILAMENT YARN WITH COLOR-POINT HEATHER APPEARANCE

BACKGROUND OF THE INVENTION

This invention concerns a synthetic crimped continuous filament (BCF) yarn which has been precolored or can been differentially dyed to produce a novel heather appearance.

As is known in the art, a heather appearance includes small points of individual color, i.e., color points, randomly distributed throughout a matrix of contrasting colors. Heather BCF yarns can be made from differentially dyeable or precolored BCF component yarns in various ways to provide a variety of heather appearances. These heather appearances can range from a very bold heather with relatively large random sections of individual color, to a very fine heather having a high degree of yarn-to-yarn filament commingling between the components.

In the yarn processing art, there are two known basic yarn structures. One yarn structure characterized by loops and a continuous tangle of individual filaments, such as shown in U.S. Pat. No. 2,852,906, is referred to as "air jet textured" or "bulked". This first yarn structure shall be referred to as "textured" within this description.

The second basic structure contains nodes or densely entangled sections separated by bulkier non-entangled sections, such as shown in U.S. Pat. No. Re. 31,376. The nodes are referred to as "intermingled", that is, entangled without forming loops. These nodes are also referred to in the art as "compacted". Yarns with compacted nodes and bulkier non-entangled sections are referred to herein as "interlaced". "Commingling" refers to filament blending between different yarns. The densely entangled nodes of the second yarn structure prevent commingling with another yarn.

The patent to Nelson, U.S. Pat. No. 4,343,146, discloses a process for producing heather BCF yarns in which a first yarn is entangled with at least one second yarn which is precolored or differentially dyeable with respect to the first yarn and which contains frequent periodic short relatively compact nodal regions of high-filament entanglement. When the first and second yarns are textured according to the described Nelson process, the nodal regions of the second yarn are substantially free from commingling with filaments of the first yarn, and the nodal regions are separated by bulkier relatively open regions of fully textured first and second yarns. The Nelson '146 patent describes known prior art jet entangling or interlacing procedures to produce the color-point second yarn having periodic nodal regions.

Due to the high popularity of BCF heather yarns in the tufted carpet market, distinctive novel heather effects are in high demand. However, as the Nelson reference acknowledges, the preparation of acceptable new yarns has remained difficult due to the necessity of combining the component yarns in a sufficiently random yet consistent manner to obtain a distinctive and desirable heather appearance. Much of the difficulty in producing distinct BCF heather yarns is the need to prevent the formation of directional carpet appearance or patterns, such as streaks and chevrons in the finished product. Prior jet interlacing processes as described in the Nelson '146 patent, frequently rely upon multiple tensions applied to the yarn components, which tensions tend to vary over time, requiring constant attention to the tensioning mechanisms. In addition, if it is desired to vary the tensions on the several components to cause multiple colors to stand out randomly, making these tension changes quickly enough to prevent directional carpet appearance is extremely difficult.

SUMMARY OF THE INVENTION

An apparatus and process for producing a crimped continuous filament yarn product is adapted for use with a known yarn processing machine that includes a jet interlacer for combining a plurality of yarns. The combined yarn product comprises a first yarn in the form of a loose matrix of filaments substantially free of filament entanglement. A second color-point yarn, which is precolored or differentially-dyeable with respect to the matrix yarn, contains randomly distributed relatively compact nodal regions of high filament entanglement separated along the length of the second yarn by relatively open regions of filaments adapted for commingling with filaments of the first matrix yarn. The matrix yarn and color-point yarn are interlaced in a known manner to form a relatively uniform density yarn product in which the first and second yarns are commingled between the nodal regions of the color-point yarn, but substantially free from commingling in the nodal regions, to produce a random heather appearance.

In one aspect of the invention, the second color-point yarn filaments are passed through a first entangling zone comprising a jet interlacer of known construction, with the novel modification that the fluid source to the interlacer is randomly controlled by a fast-action solenoid. The solenoid operates to rapidly and controllably open and close a valve disposed in the fluid source, thereby stopping and starting the fluid jet through the interlacer. A programmable controller controls the operation of the solenoid to produce randomly distributed nodal regions in the color-point yarn and to controllably vary the length of the nodal regions. The programmable controller implements a routine for producing "controlled randomness" in the length and distribution of the nodal regions. Nodal distributions can be varied from as many as twenty nodes per meter down to as few as two or three nodes per meter.

In another embodiment of the invention, the jet interlacer comprises a known open jet interlacer. The color-point filaments are guided through the interlacer by a first yarn guide at the entrance of the interlacer, and a second controllable yarn guide at the exit. The second yarn guide is attached to the plunger of a fast-acting solenoid which operates to extend or retract the yarn guide. In the retracted position, the yarn guide guides the color-point filaments through the open jet interlacer to produce nodal regions of high filament entanglement. In the extended position, the yarn guide moves the color-point filaments out of the open interlacer so that no filament entanglement occurs. The solenoid controlling the movement of the yarn guide can be controlled by the same programmable controller as in the previous embodiment. The product of this embodiment can have the same controlled randomness of the color-point heather as the prior embodiment.

It is one object of the invention to provide a process and apparatus for performing the process to produce a crimped continuous filament yarn with a color-point heather appearance. One particular object is to provide means for producing controlled random nodal regions in a number of color-point yarns for entangling with a number of matrix yarns in which the nodal regions of the color-point yarns are substantially free from commingling with the matrix yarns.

It is a further object to introduce an apparatus and process that is less susceptible to producing yarn products having directional appearances and that can more efficiently and easily produce controlled random nodal regions in the color-point yarns than prior apparatus and processes.

One benefit of the present invention is that the matrix and color-point yarns can be supplied at generally uniform feed rates, without the need for varying the feed rates of a yarn to produce the desired appearance. Another benefit is that the final BCF heather product produced by the invention has a substantially uniform linear density.

Other objects and benefits of the present invention will become apparent from the following written description and accompanying figures.

DESCRIPTION OF THE PREFERRED EMBODIMENT

Figure 1:
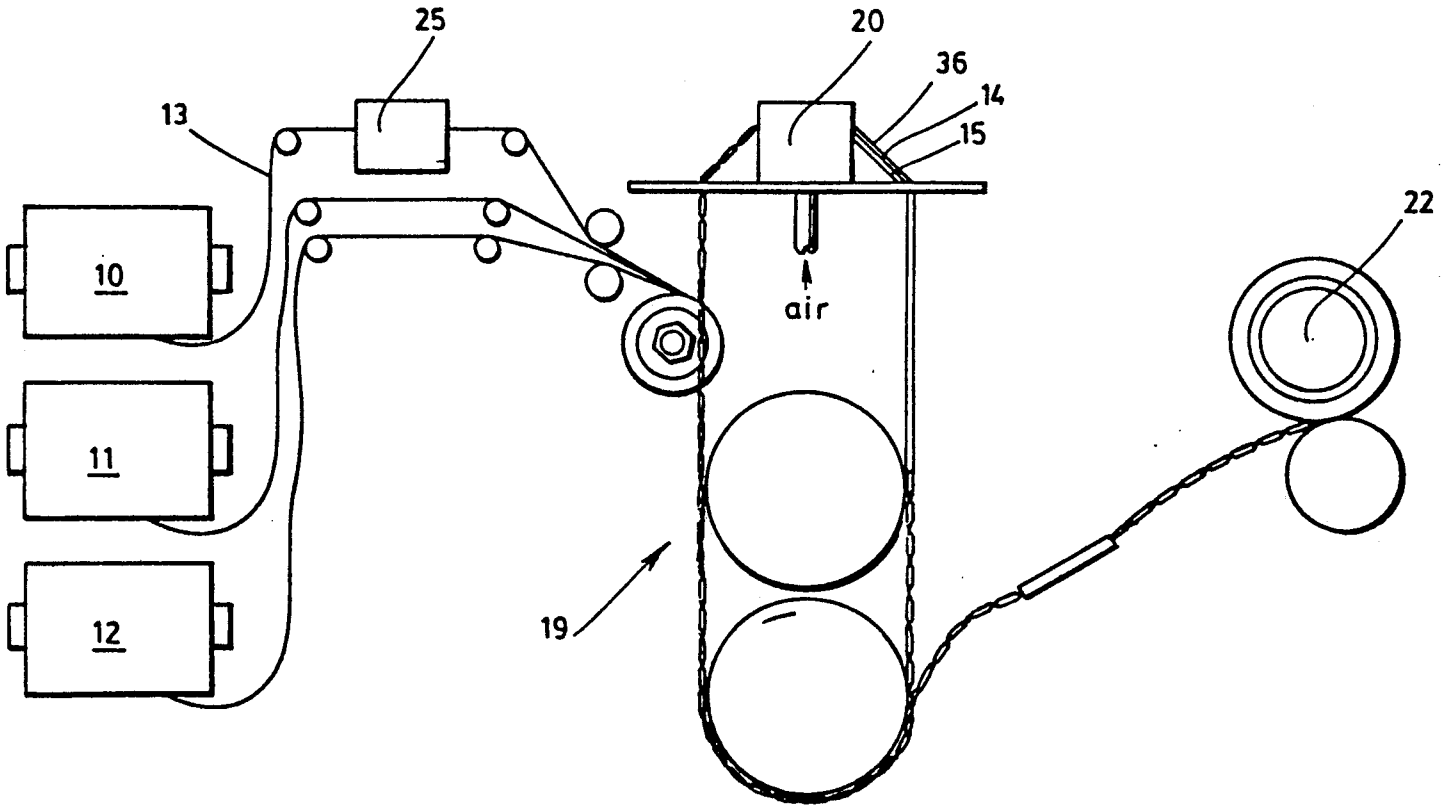
FIG. 1 is a schematic representation of a system for performing a process of this invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Conventional BCF carpet yarns can be used as the component feed yarns for the process of the present invention. One specific preferred product was produced from nylon 6 having a denier of approximately 1115. As shown in FIG. 1, a number of creel packages 10, 11 and 12 carry a plurality of polyamide feed yarns 13, 14 and 15, respectively. Each of the plurality of feed yarns are withdrawn and passed through the individual components of a known yarn production apparatus 19, such as an apparatus known as a "Gilbos" machine, which is described in U.S. Pat. No. 4,570,312, which description is incorporated herein by reference. As known in the art, the yarns being drawn from the creel packages 10–12 are ultimately commingled in an entangling zone, such as a by a jet interlacer 20 in FIG. 1, to produce a BCF product that is wound onto a yarn package 22 at the end of the process. In the preferred embodiment, a number of the plurality of yarns 13–15 can have the same color, or at least have the same dyeing capacity, while the remainder of the yarns can be of a number of other colors. In one specific embodiment, the yarn 13 from creel package 10 consists of a red color-point end, while the yarns 14 and 15 constitute a green matrix yarn.

The green matrix yarns 14 and 15 can be fed to a conventional uniform interlacing device prior to the machine 19, that can entangle the filaments of the matrix yarn substantially free of filament nodes. For example, the matrix filaments can be fed through a hot fluid jet crimper, such as described in U.S. Pat. No. 4,059,873 to Nelson, as well as in the Nelson '146 patent. It is known that the processes described in these two patents, which descriptions are incorporated herein by reference, produce a crimped yarn in which the filament bundles can open to a certain extent so that filaments of another yarn can be blended.

Figure 2:
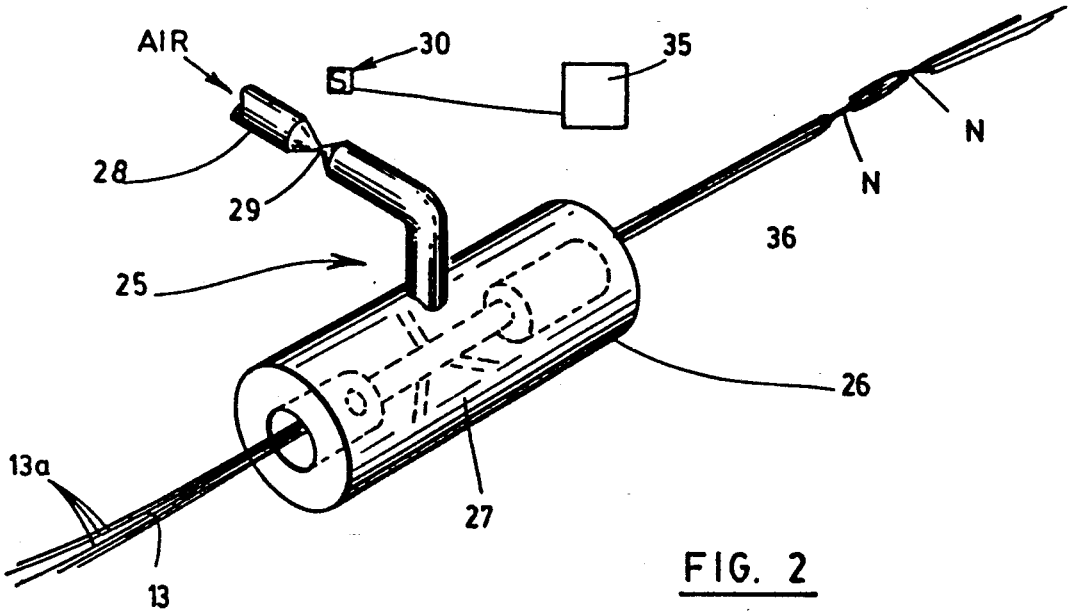
FIG. 2 is an enlarged simplified perspective view of an interlacing assembly of one embodiment of this invention for use in the system shown in FIG. 1.

The red color-point yarn 13, however, is introduced into a first entangling zone comprising a jet interlacer assembly 25 according to the present invention. The details of one embodiment of the assembly 25 are shown in FIG. 2. In this embodiment, the jet interlacer assembly 25 includes a known nodal interlacing device 26 for commingling yarn filaments, such as the device described in U.S. Pat. No. 3,828,404 to Peckinpaugh, which description is incorporated herein by reference. In this interlacing device 26, an air jet body 27 is fed from a fluid source 28. The pressure and velocity of the fluid from the air jet determines the amount of nodal interlacing of the separate filaments 13*a* comprising the color-point yarn. The flow of fluid, such as air, through fluid source 28 into the jet body 27 is controlled by a valve 29 within the fluid source 28. The valve 29 is opened and closed by a fast-action solenoid 30. Actuation of the solenoid 30, and thereby the valve 29, is controlled by a programmable controller 35. The programmable controller 35 implements a routine for randomly actuating the solenoid 30, which randomly opens and closes the valve 29, thereby randomly stopping and starting the flow of fluid to the jet component 27.

The controller 35 can be programmed to control the action of the solenoid 30 so that the color point yarn product 36 exiting the air jet interlacing assembly 25 can have as many as twenty nodes N per meter (which traditionally constitutes a fully entangled yarn), or as few as two or three nodes N per meter. The length of a given node N can also be controlled by varying the duration of the fluid jet, although a typical node length is one-half inch.

The controller 35 can be a conventional numerical controller of the type shown in U.S. Pat. No. 3,748,648, the disclosure of which is incorporated herein by reference. It is within the ordinary skill of one in the art to develop a routine to be implemented by the controller 35 that can produce "controlled randomness" in the nodes of the color point yarn product 36 exiting the jet interlacing assembly 25. This "controlled randomness" in the color-point yarn nodes leads to a random heather appearance in the final carpet yarn product.

The matrix component yarns 14 and 15 and the color-point yarn product 36 are fed to a second entangling zone comprising the conventional jet entangling device 20 of the yarn processing system 19 (FIG. 1). The jet entangling device 20 may be constructed as shown in U.S. Pat. No. 4,841,606 to Coons, III. The nodes N in the color-point yarn product 36 prevent filament blending or commingling with the matrix yarns 14 and 15 at the node points, giving the appearance in the final product of a short color-pure "fleck". The frequency of these flecks is determined by the frequency of the nodes N in the color point product 36, and ultimately by the routine implemented by the programmable controller 35. The final product BCF heather yarn has a substantially uniform linear density.

Figure 3:
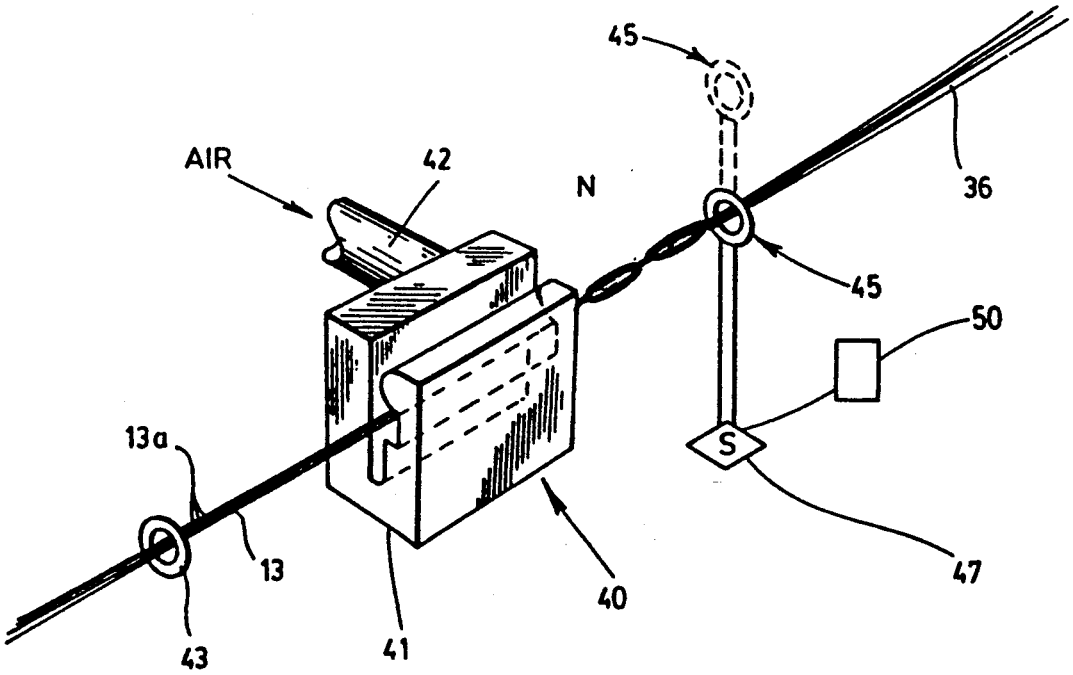
FIG. 3 is an enlarged simplified perspective view of an interlacing assembly of another embodiment of this invention for use in the system shown in FIG. 1.

In another embodiment of the invention, the nodal interlacer assembly 25 is replaced by an interlacer assembly 40 of an alternative design shown in FIG. 3. This alternative assembly 40 includes a standard open jet interlacer 41. The open interlacer can be of the type described in U.S. Pat. No. 3,115,691, which disclosure is incorporated herein by reference. The color point yarn strands 13*a* are fed through a first yarn guide 43 prior to the open interlacer 41. A second yarn guide 45 is situated at the exit of the jet interlacer 41 and is mounted to a plunger 46 of a fast-action solenoid 47, which can be the same as the solenoid 30 of the previous embodiment. This fast-action solenoid 47 is connected to a programmable controller 50, which can be identical to the programmable controller 35 of the previous embodiment.

The interlacer assembly 40 operates by moving the color-point yarn 13 into and out of the fluid stream of the open jet interlacer 41. The solenoid 47 can be energized to move from a retracted position in which the yarn guide 45 is aligned with the jet interlacer 41, to an extended position with the yarn guide in the position designated 45' in which the yarn 13 is pulled out of the open interlacer jet stream. It is understood that when the yarn filaments are moved out of the fluid stream, no nodes N' are formed. Nodal interlacing occurs when the filaments 13*a* are subjected to the fluid stream within the interlacer 41. Just as with the previous embodiment, the second yarn guide 45 can be randomly controlled so that the nodes N' within the color-point yarn product 36' are randomly dispersed along the length of the yarn component. In addition, the first yarn guide 43 can also be randomly controlled by a separate solenoid.

It is understood that the present invention can be employed with any number of colors, whether the yarns constitute color-point yarns or matrix yarns. For example, three different colors of yarns can be combined into a final BCF product. Any combination of the yarns can be passed through the nodal interlacer assemblies 25 or 40 of the present invention to produce randomly dispersed nodes in the component yarns. These randomly dispersed nodes will produce a wide variety of arrangements of color flecks within the final BCF. yarn product.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A process for making a heather-dyeable or precolored heather yarn product comprising:

supplying a first crimped continuous filament yarn in the form of a loose matrix substantially free of filament entanglement;

supplying a second crimped continuous filament yarn which is precolored or differentially dyeable with respect to the first yarn;

feeding the second yarn through a first entangling zone; programming random exposure of the second yarn to a fluid jet in the first entangling zone, the fluid impinging the yarn perpendicular to the direction of feeding, to produce a color-point yarn product as the second yarn exits the first entangling zone, the color-point yarn product having relatively compact nodal regions of high entanglement of the filaments of the second yarn separated by bulkier regions of the same filaments relatively free of entanglement; and feeding the first yarn and the color-point yarn product through a second entangling zone randomly entangling filaments of the yarns from yarn-to-yarn in which yarn-to-yarn filament commingling is substantially prevented within the nodal regions of the color-point yarn.

2. The process for making a heather-dyeable or precolored heather yarn product of claim 1, wherein:

said first entangling zone includes a fluid jet interlacing device; and said step of programming random exposure includes programming random flow of fluid to the jet interlacing device.

3. The process of making a heather-dyeable or precolored heather yarn product of claim 1, wherein:

said first entangling zone includes an open fluid jet interlacing device;

said step of feeding the second yarn includes passing the second yarn through a yarn guide; and said step of programming random exposure includes random retracting and extending of the yarn guide to move the second yarn into and out of the fluid jet of the interlacing device.

4. The process for making a heather-dyeable or precolored heather yarn product of claim 1, wherein a plurality of crimped continuous filament yarns having a loose matrix are supplied and fed with the color-point yarn product through the second entangling zone.

5. The process for making a heather-dyeable or precolored heather yarn product of claim 1, wherein a plurality of precolored or differentially dyeable crimped continuous filament yarns are supplied and are each fed through a corresponding first entangling zone to produce a plurality of color-point yarn products, and each of said plurality of color-point yarn products is fed through the second entangling zone.

6. The process for making a heather-dyeable or precolored heather yarn product of claim 5, wherein a plurality of crimped continuous filament yarns having a relative loose matrix are supplied and fed with the plurality of color-point yarn products through the second entangling zone.

7. An apparatus for making a heather-dyeable or precolored heather yarn product comprising:

means for supplying a first crimped continuous filament yarn in the form of a relatively loose matrix substantially free of filament entanglement;

means for supplying in a direction of supply a second crimped continuous filament yarn which is precolored or differentially dyeable with respect to the first yarn;

a first entangling device including a fluid jet adapted to interlace filaments of a yarn passing therethrough by impinging a fluid perpendicular to the direction of supply;

means for feeding said second yarn through said first entangling device;

means for programming random exposure of said second yarn to said fluid jet to produce a color-point yarn product as said second yarn exits said first entangling device, said color-point product having relatively compact nodal regions of high entanglement of the filaments of said second yarn separated by bulkier regions of the same filaments relatively free of entanglement; and a second entangling device having a fluid jet adapted to randomly entangle filaments of yarns passing therethrough; and means for feeding said first yarn and said color-point yarn product through said second entangling device, whereby filament commingling between said first yarn and said color-point yarn product is substantially prevented within said nodal regions of said color-point yarn.

8. The apparatus for making a heather-dyeable or precolored heather yarn product of claim 7, wherein:

said first entangling device includes a fluid source for supplying fluid to said fluid jet with a valve interposed between said fluid source and said fluid jet; and means for programming random exposure includes means for randomly opening and closing said valve to interrupt the flow of fluid to said fluid jet.

9. The apparatus for making a heather-dyeable or precolored heather yarn product of claim 8, wherein said means for programming random exposure includes:

a solenoid engaged to said valve and operable to open and close said valve; and a programmable controller electrically connected to said solenoid, said programmable controller adapted to implement a routine for controlling said solenoid to randomly open and close said valve.

10. The apparatus for making a heather-dyeable or precolored heather yarn product of claim 7, wherein:

said means for feeding said second yarn through said first entangling device includes a yarn guide with said second yarn passing therethrough; and said means for programming random exposure includes means for randomly retracting and extending said yarn guide to move said second yarn into and out of said fluid jet.

11. The apparatus for making a heather-dyeable or precolored heather yarn product of claim 10, wherein:

said first entangling device includes an open fluid jet interlacing device.

12. The apparatus for making a heather-dyeable or precolored heather yarn product of claim 10, wherein said means for programming random exposure includes:

a solenoid engaged to said valve and operable to open and close said valve; and a programmable controller electrically connected to said solenoid, said programmable controller adapted to implement a routine for controlling said solenoid to randomly open and close said valve.

* * * * *